US005669084A

United States Patent [19]

Sakimura

[11] Patent Number: 5,669,084

[45] Date of Patent: Sep. 23, 1997

[54] SIMPLE TOILET

[76] Inventor: Yoshikuni Sakimura, 7-16, Goeku 1-Chome, Okinawa-Si, Okinawa, 904, Japan

[21] Appl. No.: 631,269

[22] Filed: Apr. 12, 1996

[30] Foreign Application Priority Data

Nov. 1, 1995 [JP] Japan ..... 7-306403

[51] Int. Cl.[6] ..... A47K 11/06

[52] U.S. Cl. ..... 4/480; 4/460; 4/479

[58] Field of Search ..... 4/480, 452, 460, 4/479, 450, 457

[56] References Cited

U.S. PATENT DOCUMENTS 3,611,457 10/1971 Wippich ..... 4/480
3,771,493 11/1973 Chandor ..... 4/452
4,606,080 8/1986 Clementino ..... 4/452
5,095,556 3/1992 Franey ..... 4/460
5,170,516 12/1992 Davison ..... 4/479

*Primary Examiner*—David J. Walczak
*Attorney, Agent, or Firm*—McGlew and Tuttle

[57] ABSTRACT

A portable toilet that can be simply used by wheelchair users such as impaired people without raising their buttocks. An evacuation opening with a cover that can be removed frontways is formed in the center of a stool having its fixture on the seat surface of a wheelchair. A slidable mounting plate to which an evacuation bag is attached engages the bottom surface of the stool.

4 Claims, 4 Drawing Sheets

SIMPLE TOILET

BACKGROUND OF THE INVENTION

1. Field of the Invention

The present invention relates to a simple toilet for evacuation which can be used anywhere by wheelchair users such as impaired people, people who require nursing, or patients confined to bed. The invention can be used with simple or no assistance, or by normal people during leisure activities or excursions if they cannot find a toilet.

2. Description of the Prior Art

Conventionally, when relieving themselves, those impaired people who cannot walk without a wheelchair have had someone take themselves to the toilet or place a simple stool below their buttocks. Otherwise, they have worn a diaper.

Conventionally, the impaired have not been able to raise their buttocks easily in a wheelchair, and thus have required someone's assistance to go to a stool. Consequently, without assistance, they cannot go on excursions or join outdoor activities. Furthermore, such care is a large burden on people who nurse the impaired, and they often suffer lumbago. This is thus one of several major social problems.

In addition, normal people may have to relieve themselves in the open air if they cannot find a toilet during leisure activities or disasters. This may cause environmental contamination and is undesirable. Of course, the outdoor evacuation is also unsightly.

BRIEF SUMMARY OF THE INVENTION

This invention enables those impaired people who cannot walk without a wheelchair to relieve themselves in the wheelchair without raising their buttocks, and also enables simple disposal in the same position after evacuation.

This invention thus provides a wheelchair with a seat surface comprising a covered stool wherein the central cover is withdrawn frontward to form an evacuation opening in the center of the stool and wherein a detachable evacuation bag is suspended below the seat surface. This evacuation bag can be removed when withdrawn forward with a mounting plate, thereby enabling easy disposal. The impaired people can thus relieve themselves in a wheelchair without raising their buttocks.

Normal people can also use this simple toilet in the open air during leisure activities by setting it on a buildup pedestal.

The various features of novelty which characterize the invention are pointed with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DETAILED DESCRIPTION OF THE PREFERRED EMBODIMENTS

Figure 1:
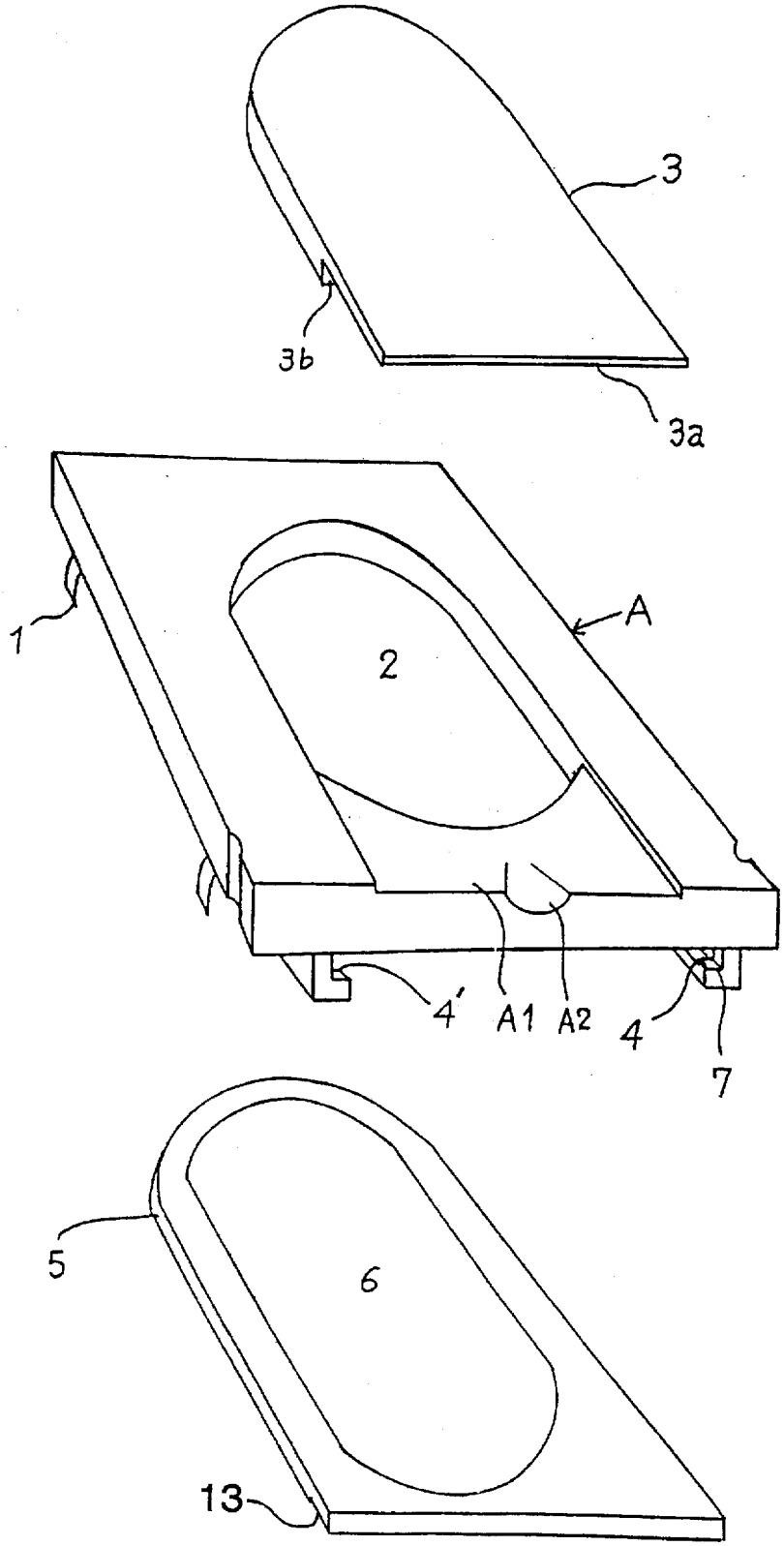
FIG. 1 is a perspective view showing pre-assembly conditions.
Figure 2:
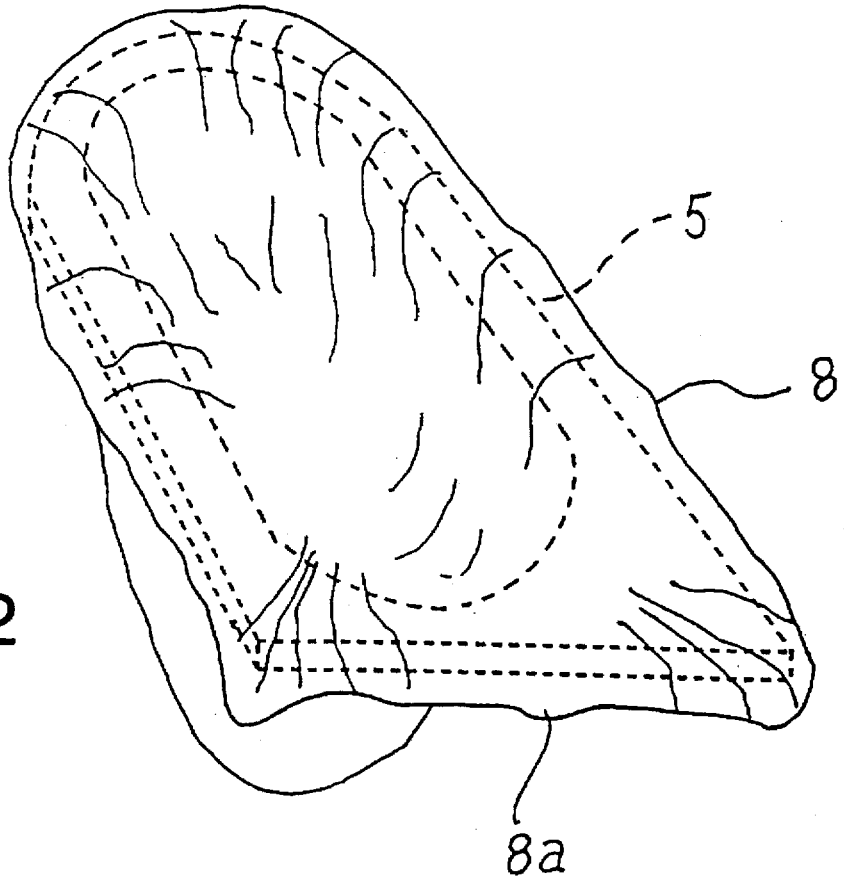
FIG. 2 is a perspective view showing a bag set on a mounting plate.
Figure 3:
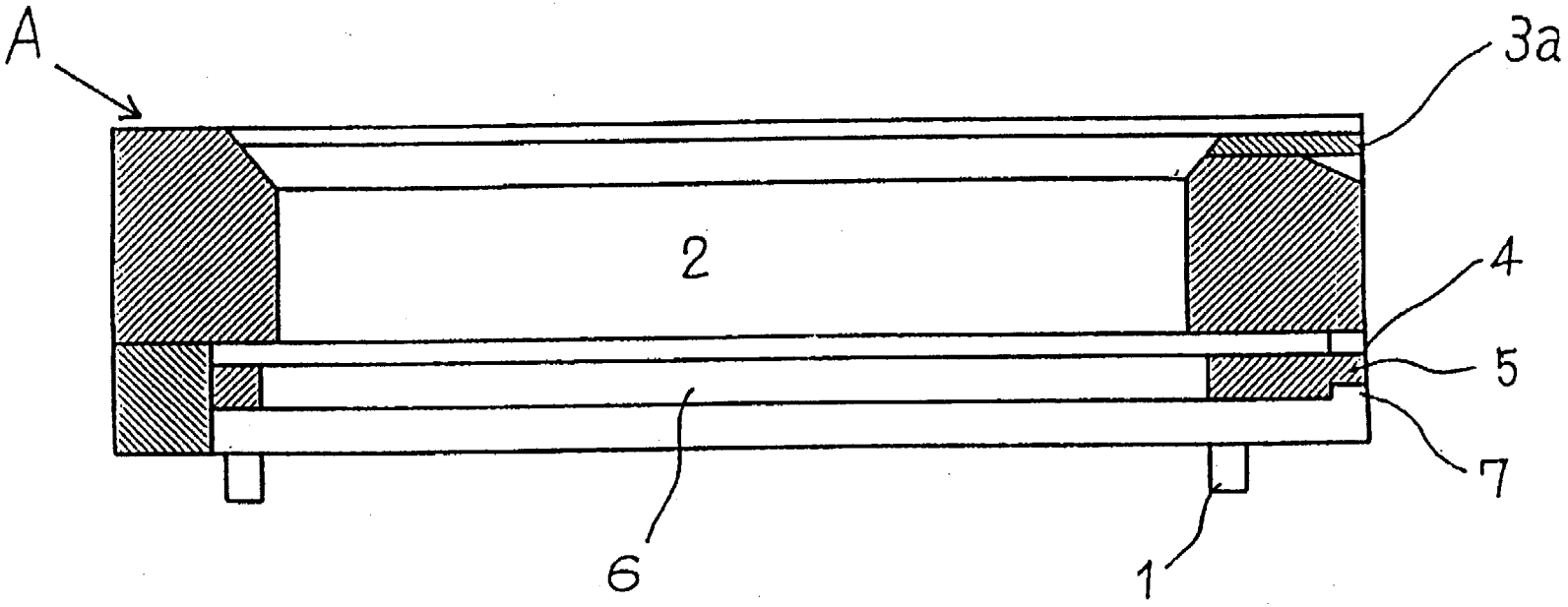
FIG. 3 is a cross section showing assembled conditions.

A simple toilet according to this invention has hooks 1 disposed in two or more positions on both sides of a wheelchair and engaging a seat fixing pipe installed on both sides of the wheelchair. A stool A has an evacuation opening 2 in the center. A cover 3 for the evacuation opening 2 is supported by an appropriate number of convex or stage portions formed on the opening wall of the evacuation opening so that the cover is located below the top surface of the stool and so that an evacuation bag can be suspended from the evacuation opening. A pair of engaging grooves 4 and 4' are provided so as to protrude on the respective sides of the bottom surface of the stool and are centrally and laterally opened. A mounting plate 5 has a cut hole 6 as large as the evacuation opening 2 and engaging the engaging grooves. The mounting plate is formed so that it can be withdrawn forward. The mounting plate 5 has an evacuation bag 8 of polyethylene or the like which is suspended from the cut hole 6 and which is set so that the bag opening encompasses the top surface of the mounting plate 5 and so that a bag opening end **8*a* dangles from the periphery of the mounting plate 5. The bag opening is sandwitched between the top surface of the mounting plate 5** and the bottom surface of the stool A.

A wavy notch is preferably provided in the outer circumference of the mounting plate 5 to prevent the bag opening from slipping out.

Figure 4:
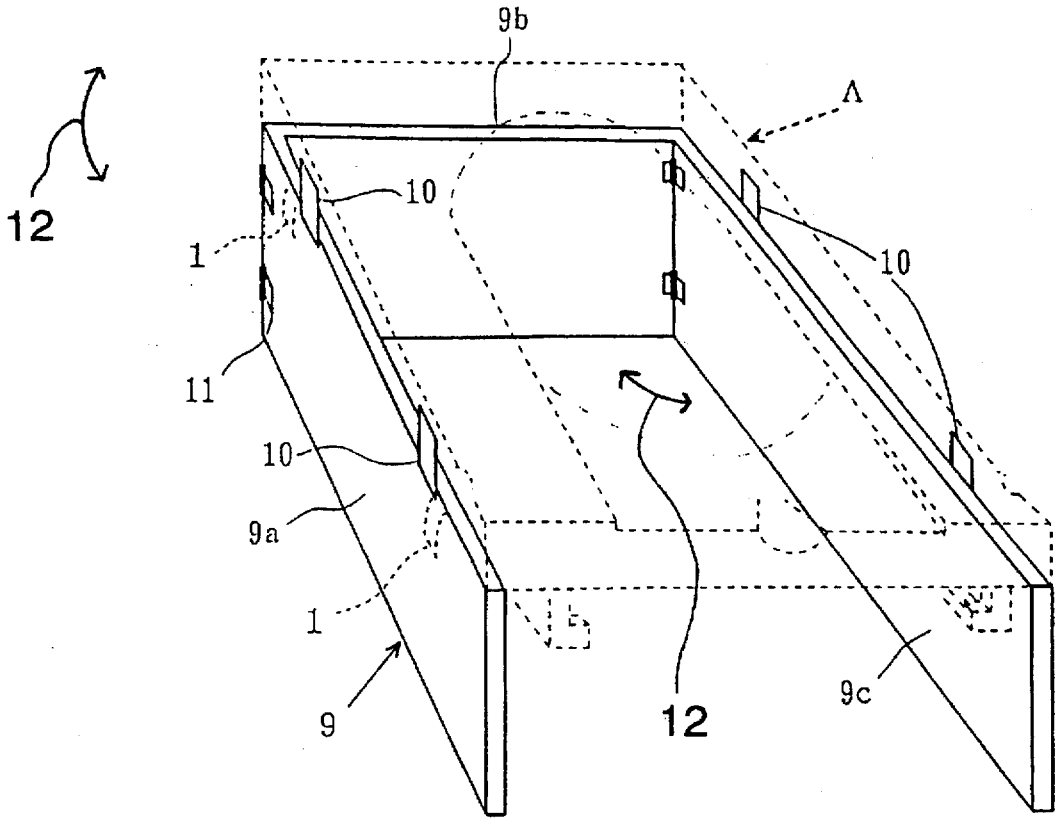
FIG. 4 is a perspective view of a pedestal.

FIG. 4 shows a pedestal 9 used when the wheelchair is not used. The pedestal 9 comprises three plates **9*a* to 9*c* corresponding to the length of each side of the right and left and rear sides of the stool A, respectively, and which are foldably connected via hinges 11. The pedestal is extended in a U-shape as a frame, and the stool is placed on it. The evacuation bag is then hung inside the frame. Each of the side plates 9*a* and 9*c* of the pedestal 9 are foldable in the same direction as shown by each of the arrows 12. The pedestal 9 has four or more nails or tabs 10 protruding upward on the side plates 9*a*, 9*c*. The nails or tabs 10 are positioned just inside of the hooks 1, so that the stool A is prevented from sliding on the pedestal 9 when the stool plate is mounted on the pedestal 9 and the hooks 1 engage with the plates 9*a* to 9*c* as shown in FIG. 4**.

A part of a rear surface of the front end **3*a* of the cover 3 that does not correspond to the evacuation opening 2 is thin and has a cover stage portion 3*b*. A shallowly notched cover receiving groove A1 is provided between the evacuation opening and front end of the stool A, so that the cover stage portion 3*b* engages the cover receiving groove A1. A finger insertion recess portion A2 is more deeply notched in the center of the notched cover receiving groove A1 for allowing the user to grip the cover 3** more easily.

A stopper means 7 is preferably attached to the front end of the engaging grooves 4 and 4' with which a mounting stage portion 13 of the mounting plate 5 is engaged, in order to prevent the front end of the mounting plate from inadvertently slipping out. This stopper 7 may be a self-righting piece such that, for example, a slightly raised mounting plate 5 can be withdrawn from above the stopper.

The cover 3 may be supported on the evacuation opening 2 by providing an engagingly locking stage on the opening wall of the evacuation opening 2 or a horizontally protruding receiver in front right and left and rear positions.

While the simple toilet according to this invention is out of use, the stool remains covered, and the mounting plate 5 remains engaged with the rear surface of the stool and is used as the seat surface sheet for the wheelchair. To fold the wheelchair, the overall stool is removed from the seat surface sheet fixing pipes and then engaged with the handle. The wheelchair can then be transported.

Due to its simple structure described above, this invention can be produced easily and requires small costs.

Even the impaired can use this invention in the wheelchair without raising their buttocks by inserting their finger into the finger insertion groove at the front end of the stool and slightly raising and withdrawing the cover. The cover is thus disposed somewhat below the stool surface so as not to be subjected to the pressure from the surface of their buttocks. When they close the cover, their buttocks or thighs are prevented from being caught, so they can use this toilet simply.

According to this invention, the evacuation bag 8 is attached to the mounting plate 5 and suspended therefrom. The wheelchair normally includes X-shaped fixtures in two positions so as to improve the strength and stability of the portion below the seat surface, thereby failing to allow the use of a solid evacuation container. This invention, however, enables a soft bag of, for example, polyethylene or the like to be attached simply, and can thus be used in the wheelchair despite the presence of X-shaped fixtures.

The toilet according to this invention can be conveniently transported because after use, it can be removed from the wheelchair and hung from its side like a plate.

In this manner, the use of the simple toilet according to this invention enables the impaired people to join outdoor and social activities and to become socially independent, improves their mental hygiene, and contributes to more sophisticated character formation.

This invention can also be used by normal people during outdoor activities, thereby ensuring pleasant leisure activities and preventing environmental contamination.

While specific embodiments of the invention have been shown and described in detail to illustrated the application of the principles of the invention, it will be understood that the invention may be embodied otherwise without departing from such principles.

What is claimed is:

1. A toilet comprising:

a stool plate defining an evacuation opening in a center of said stool plate, said stool plate including a first and second side;

a plurality of hook means mounted on said stool plate and for engaging a seat surface sheet fixing pipe of a wheelchair;

a cover positionable in said evacuation opening, said stool plate including a plurality of convex portions for supporting said cover in said evacuation opening at a position below said first side of said stool plate;

a pair of engaging grooves positioned on said second side of said stool plate and at opposite sides of said evacuation opening, said engaging grooves being centrally and laterally opened;

a mounting plate slidably mounted in said pair of engaging grooves, and slidably removable from one end of said stool plate, said mounting plate defining a cut opening having a size substantially similar to a size of said evacuation opening;

an evacuation bag suspended from said cut hole in said mounting plate, said evacuation bag having an opening sandwiched between said stool plate and said mounting plate.

2. A toilet in accordance with claim 1, wherein:

said cover includes a cover stage portion;

said stool plate includes a cover receiving groove for engaging with said cover and said cover stage portion;

said mounting plate includes a mounting stage portion;

said stool plate includes a stopper means positioned in one of said engaging grooves for selectively engaging said mounting stage portion and blocking sliding of said mounting plate out of said stool plate.

3. A toilet in accordance with claim 2, further comprising:

a pedestal including three plates engagable with said plurality of hooks, said three plates being foldably attached to each other;

a plurality of tabs extending from said pedestal and positioned inside of said plurality of hooks when said stool plate is positioned on said pedestal.

4. A toilet in accordance with claim 1, further comprising:

a pedestal including three plates engagable with said plurality of hooks, said three plates being foldably attached to each other;

a plurality of tabs extending from said pedestal and positioned inside of said plurality of hooks when said stool plate is positioned on said pedestal.

* * * * *